US011076232B2

(12) United States Patent
Song et al.

(10) Patent No.: US 11,076,232 B2
(45) Date of Patent: Jul. 27, 2021

(54) DIAPHRAGM AND SOUND GENERATOR HAVING SAME

(71) Applicant: AAC Technologies Pte. Ltd., Singapore (SG)

(72) Inventors: Wei Song, Shenzhen (CN); Zhiwei Zhong, Shenzhen (CN); Kun Han, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/727,973

(22) Filed: Dec. 27, 2019

(65) Prior Publication Data

US 2020/0280803 A1 Sep. 3, 2020

(30) Foreign Application Priority Data

Feb. 28, 2019 (CN) ..... 201910149045.8

(51) Int. Cl.
*H04R 7/12* (2006.01)
*H04R 9/02* (2006.01)

(52) U.S. Cl.
CPC ..... *H04R 7/127* (2013.01); *H04R 9/025* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,697,496 | B2 * | 2/2004 | Frasl | H04R 7/20 181/171 |
| 7,054,459 | B2 * | 5/2006 | Kuze | H04R 7/20 181/172 |
| 7,275,620 | B1 * | 10/2007 | Diedrich | H04R 7/16 181/171 |
| 7,428,946 | B2 * | 9/2008 | Honda | H04R 7/18 181/163 |
| 2010/0158306 | A1 * | 6/2010 | Inaba | H04R 7/20 381/398 |
| 2015/0139477 | A1 * | 5/2015 | Tripp | H04R 7/16 381/398 |
| 2016/0119716 | A1 * | 4/2016 | Wang | H04R 7/16 181/171 |
| 2018/0367908 | A1 * | 12/2018 | Wu | H04R 7/16 |

* cited by examiner

*Primary Examiner* — Fan S Tsang
*Assistant Examiner* — Angelica M McKinney
(74) *Attorney, Agent, or Firm* — W&G Law Group LLP

(57) ABSTRACT

The invention discloses a diaphragm and a sound generator having a diaphragm. The diaphragm includes a dome part arranged centrally and a suspension part surrounding the dome part. The suspension part is provided with pleat groups. The pleat group includes many pleats, and each pleats includes a first pattern section, a second pattern section, and a third pattern section connecting the first pattern section and the second pattern section. The height of the third pattern section along the vibration direction is smaller than the protrusion height of the first pattern section and the second pattern section along the vibration direction. The diaphragm of the present invention can be used to reduce low frequency distortion.

9 Claims, 3 Drawing Sheets

DIAPHRAGM AND SOUND GENERATOR HAVING SAME

FIELD OF THE PRESENT DISCLOSURE

The invention relates to a diaphragm, in particular to a diaphragm on a sound generator.

DESCRIPTION OF RELATED ART

More and more sound generators are applied to various electronic products with the rapid development of electronic information technology, especially as for mobile communication devices that are widely used, people not only care about their miniaturization and many functions, but also demand high quality and distortion-free voice effect. As diaphragm is the core component of a sound generator, its design directly affects the performance of acoustic devices.

A sound generator used in acoustic products usually comprises a magnetic circuit system and a vibration system. The magnetic circuit system comprises a magnetic yoke and magnets accommodated in magnetic yoke. A magnetic gap is formed between magnetic yoke and magnet. The vibration system comprises a voice coil suspended in the magnetic gap and a diaphragm connected to and driven by the voice coil. The diaphragm related to the present invention generally comprises a dome arranged at a central position, a suspension part surrounding the dome and connected to the dome, and a fixation part extending from the suspension part. The suspension part is provided with an annular convex part, and the height of the convex parts is the same. During the vibration process of the diaphragm of this structure, when the diaphragm vibrates up and down, it is likely to cause creases or concaves of the diaphragm, so that the vibration deviation of the diaphragm occurs, and low-frequency distortion of the sound generator is caused.

Therefore, it is necessary to provide a new type of diaphragm.

SUMMARY OF THE PRESENT INVENTION

One of the major objects of the present invention is to provide a diaphragm capable of reducing low frequency distortion.

In order to achieve the object mention above, the present invention discloses a diaphragm including a dome part arranged at a central position, a suspension surrounding the dome part and a plurality of pleats. The suspension includes a first fixation part connected with the dome, a suspension part surrounding the first fixation part and having a convex part protruding along a vibration direction, and a second fixation part surrounding the suspension part. The pleats protrude from the convex part, and each of the pleats includes a first pattern section, a second pattern section having a same protruding direction to the first pattern section, and a third pattern section between the first pattern section and the second pattern section. A height of the third pattern section along the vibration direction is smaller than heights of the first pattern section and the second pattern section along the vibration direction.

Further, a projection of the third pattern section along a direction vertical to the vibration direction and a projection of the convex part along the same direction are spaced from each other.

Further, an extending direction of the first pattern section toward the center of the diaphragm intersects with an extending direction of the second pattern section toward the center of the diaphragm.

Further, an extending direction of the first pattern section toward the center of the diaphragm is parallel to an extending direction of the second pattern section toward the center of the diaphragm.

Further, the suspension part further comprises a concave part denting along the vibration direction, the denting direction of the concave part is opposite to the protruding direction of the concave part.

Further, the concave part surrounds the convex part and connects the convex part to the second fixation part.

Further, the convex part is a racetrack shape, and the pleats are arranged at corners of the convex part.

In addition, the present invention provides a sound generator comprising a magnetic circuit system, a vibration system and a frame accommodating the magnetic circuit system and the vibration system, wherein the vibration system further comprises a diaphragm as described above.

Further, the convex part protrudes in a direction away from the magnetic circuit system.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
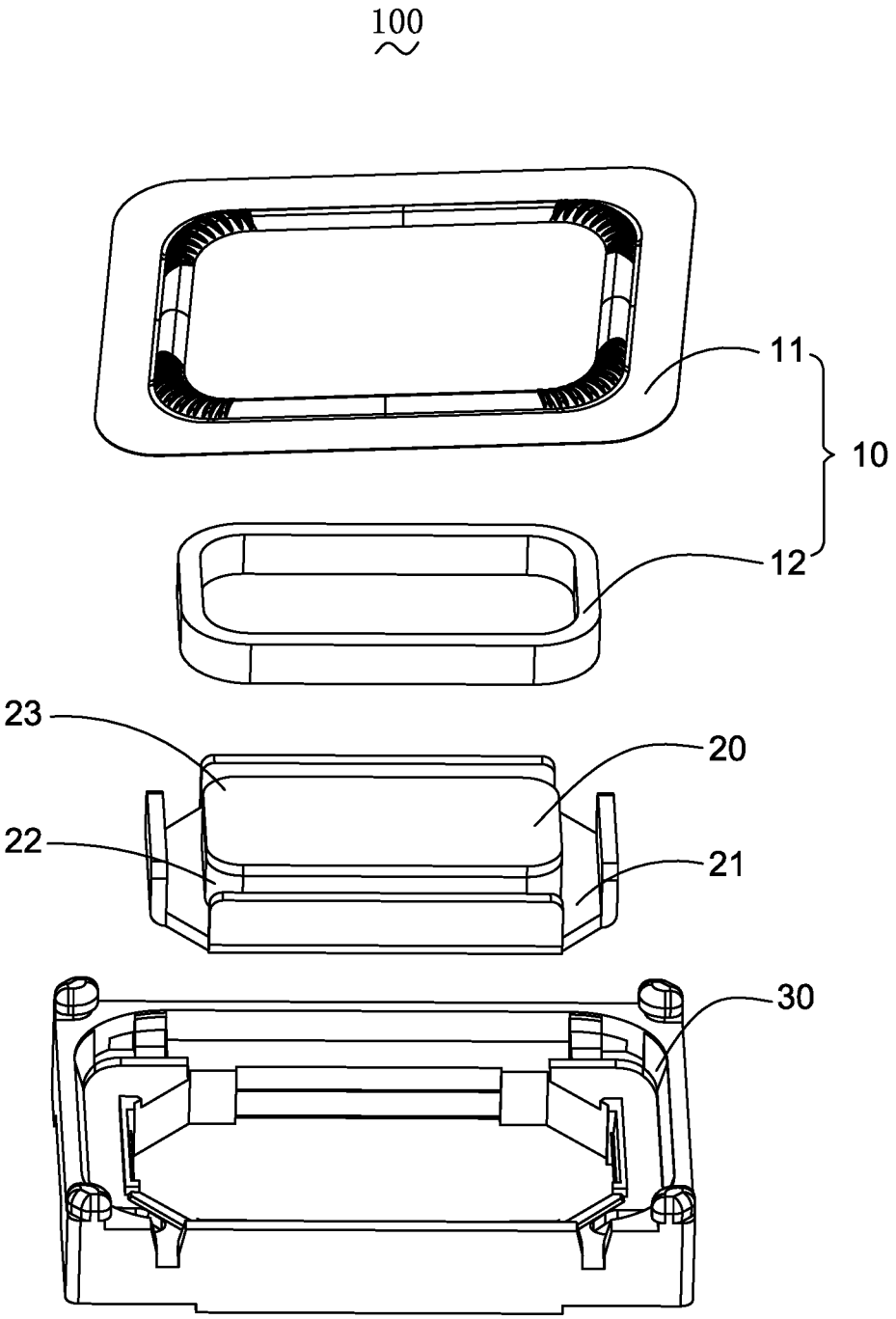
FIG. 1 is an isometric and exploded view of a sound generator in accordance with an exemplary embodiment of the present invention.

As shown in FIG. 1, a sound generator 100 of the present invention comprises a vibration system 10, a magnetic circuit system 20, and a frame 30 that accommodates the vibration system 10 and magnetic circuit system 20. The vibration system 10 comprises a diaphragm 11, and a voice coil 12 which is connected with the diaphragm 11 and drives the vibration of the diaphragm 11.

Figure 2:
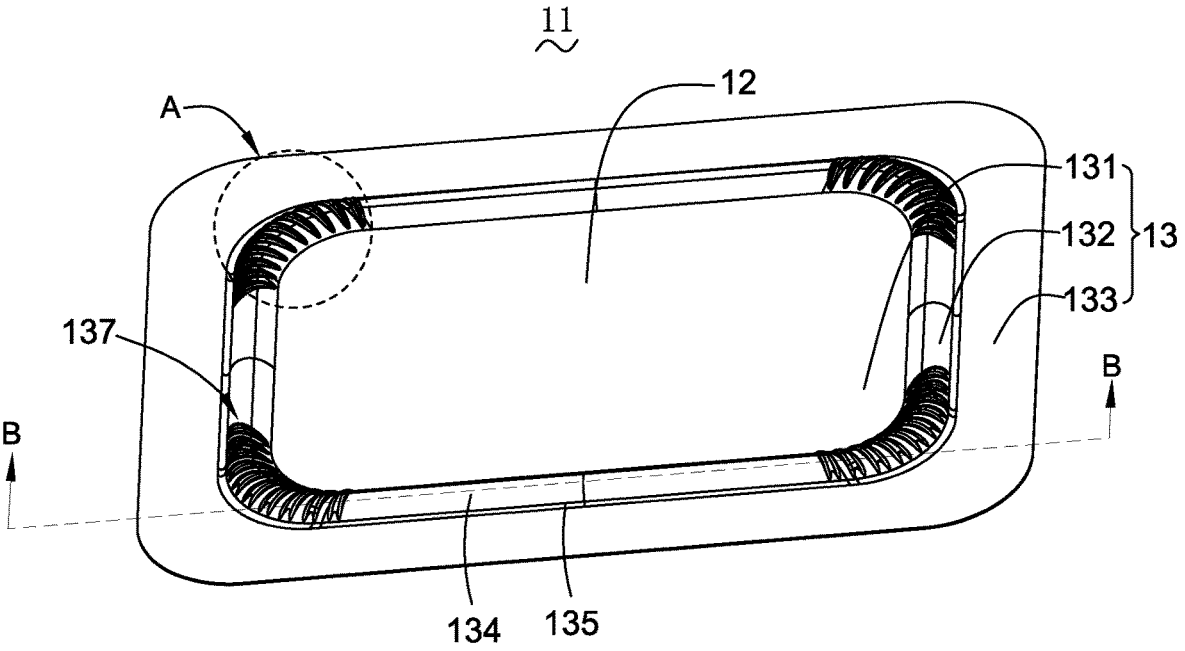
FIG. 2 is an isometric view of a diaphragm used in the sound generator.
Figure 3:
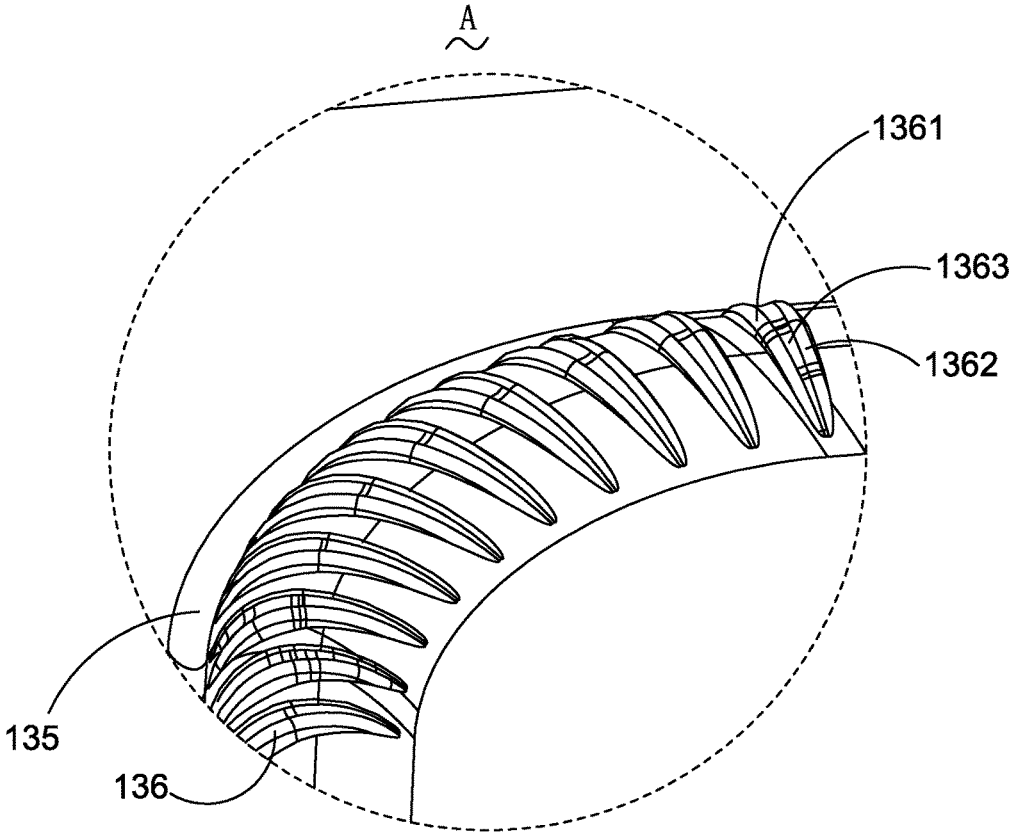
FIG. 3 is an enlarged view of Part A in FIG. 2.

As shown in FIGS. 2-3 the diaphragm 11 comprises a dome part 12 arranged in the center and a suspension 13 surrounding the dome part 12. The suspension 13 comprises a first fixation part 131 connected to the dome part 12; a suspension part 132 surrounding the first fixation part 131 and a second fixation part 133 surrounding the suspension part 132. The second fixation part 133 is fixed to the frame 30.

The magnetic circuit system 20 comprises a magnetic yoke 21 fixed on the frame 30, a magnet 22 fixed on the magnetic yoke 21, and a pole plate 23 mounted on the magnet 22.

The suspension part 132 comprises a convex part 134 protruding along a vibration direction and a concave part 135 denting along the vibration direction; the protruding direction of the convex part 134 is opposite to the denting direction of the concave part 135. Such a configuration can improve the anti-diaphragm resistance of diaphragm, enhance the vibration stability of diaphragm, and improve the vibration performance of the sound generator. In this embodiment, the convex part 134 protrudes along the direction away from the magnetic circuit system 20; in other embodiments, the convex part 134 protrudes along the direction away from the magnetic circuit system 20.

A plurality of pleats 136 protruding from the convex part 134 are arranged on the convex part 134. Each of the pleats 136 comprises a first pattern section 1361 and a second pattern section 1362 having the same protruding directions. The pleat 136 further comprises a third pattern section 1363 connecting the first pattern section 1361 and the second pattern section 1362. A height of the third pattern section 1363 along the vibration direction is smaller than a height of the first pattern section 1361 and the second pattern section 1362 along the vibration direction. A projection of the third pattern section 1363 along the vertical vibration direction and a projection of the convex part 134 in the vibration direction are spaced from each other; that is, the height of the third pattern section 1363 along the vibration direction is between the first pattern section 1361 and the convex part 134.

In this embodiment, the extending direction of the first pattern section 1361 toward the center of the diaphragm 11 intersects with the extending direction of the second pattern section 1362 toward the center of the diaphragm 11. In other embodiments, the extending direction of the first pattern section 1361 toward the center of the diaphragm 11 is parallel to the extending direction of the second pattern section 1362 toward the center of the diaphragm 11. The diaphragm 11 is rectangular, the convex part 134 is a racetrack shape, and the dome part 12 is a flat plate. The convex part 134 surrounds the dome part 12. In addition, convex part 134 is a protruding arc structure and protrudes from the surface of the dome part 12 to ensure that diaphragm 11 can freely vibrate up and down.

Figure 4:
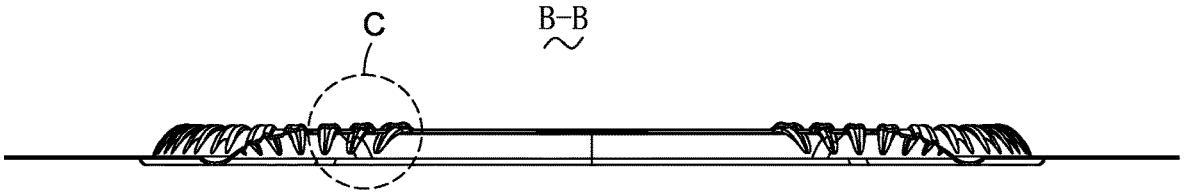
FIG. 4 is a cross-sectional view of the diaphragm taken along line B-B in FIG. 2.
Figure 5:
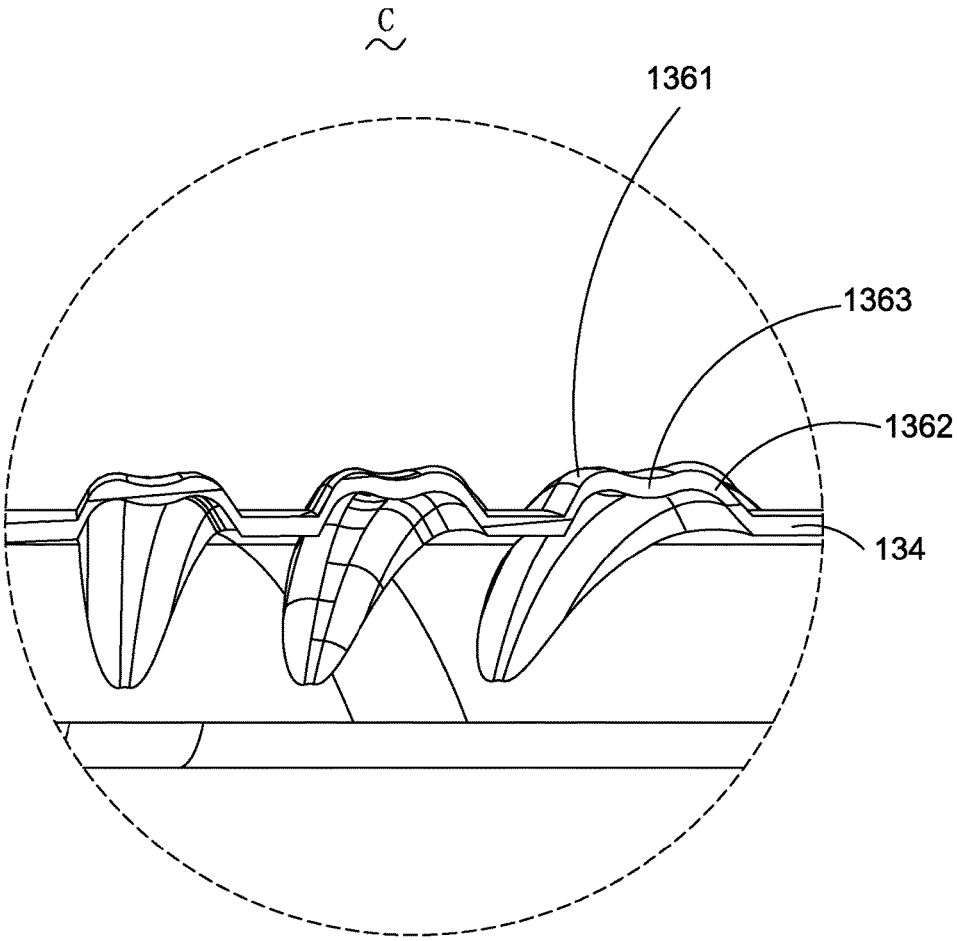
FIG. 5 is an enlarged view of Part C in FIG. 4.

In addition, referring to FIGS. 4-5, the convex part 134 is provided with a pleat group 137 to prevent vibration deviation and improve the acoustic performance of diaphragm 11. The pleat group 137 can adjust the distribution on suspension part 132 base on needs. Generally, in order to balance the vibration area of the diaphragm and avoid vibration deviation of the, at least two groups of pleat groups are arranged, and the two groups of pleat groups are oppositely arranged and symmetrically and evenly distributed on the convex part. In this embodiment, the pleat group 137 is arranged at four corners of the convex part 134, and each pleat group 137 includes a number of regular pleats 136; the pleats 136 may be protruding from the surface of the convex part 134, and the protruding direction of the pleats 136 is the same as the protruding direction of the convex part 134. In other embodiments, the pleats 136 may also be formed by dented surface of the convex part 134. In this embodiment, the pleats 136 comprises a first pattern section 1361, a second pattern section 1362, and a third pattern section 1363 arranged between the first pattern section 1361 and the second pattern section 1362. The third pattern section 1363 connects first pattern section 1361 and the second pattern section 1362. The first pattern section 1361 and the second pattern section 1362 are in long striped shape. The extension direction of the first pattern section 1361 and the second pattern section 1362 intersect, as shown in FIG. 5. The first pattern section 1361, the second pattern section 1362, and the third pattern section protruding from convex part 134. A height of the third pattern section 1363 along the vibration direction is smaller than the height of the first pattern section 1361 and the second pattern section 1362 along the vibration direction. In this embodiment, the first pattern section 1361 and the second pattern section 1362 intersect in a direction close to the center of the diaphragm 11, and are separated in a direction away from the center of the diaphragm 11 in roughly swallow tail shape. The pleats 136 can effectively reduce low frequency distortion. In addition, pleat 136 is radially distributed and radiates toward the center of the diaphragm 11. The first pattern section 1361 and the second pattern section 1362 intersect in the extension direction toward the center of the diaphragm. In this way the problem that wrinkles easily occur when diaphragm 11 vibrates can be effectively solved. The vibration deviation can be prevented effectively, so that the diaphragm is more stable during vibration, compliance of diaphragm is increased, and better low frequency performance can be obtained.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A diaphragm comprising:

a dome part arranged at a central position;

a suspension surrounding the dome part, including a first fixation part connected with the dome, a suspension part surrounding the first fixation part and having a convex part protruding along a vibration direction, and a second fixation part surrounding the suspension part;

a plurality of pleats protruding from the convex part, each of the pleats including a first pattern section, a second pattern section having a same protruding direction to the first pattern section, and a third pattern section between the first pattern section and the second pattern section; wherein a height of the third pattern section along the vibration direction is smaller than heights of the first pattern section and the second pattern section along the vibration direction.

2. The diaphragm as described in claim 1, wherein a projection of the third pattern section along a direction vertical to the vibration direction and a projection of the convex part along the same direction are spaced from each other.

3. The diaphragm as described in claim 1, wherein an extending direction of the first pattern section toward the center of the diaphragm intersects with an extending direction of the second pattern section toward the center of the diaphragm.

4. The diaphragm as described in claim 1, wherein an extending direction of the first pattern section toward the center of the diaphragm is parallel to an extending direction of the second pattern section toward the center of the diaphragm.

5. The diaphragm as described in claim 1, wherein the suspension part further comprises a concave part denting along the vibration direction, the denting direction of the concave part is opposite to the protruding direction of the concave part.

6. The diaphragm s described in claim 5, wherein the concave part surrounds the convex part and connects the convex part to the second fixation part.

7. The diaphragm as described in claim 1, wherein the convex part is a racetrack shape, and the pleats are arranged at corners of the convex part.

8. A sound generator, comprising:

a magnetic circuit system;

a vibration system;

a frame accommodating the magnetic circuit system and the vibration system, wherein the vibration system further comprises a diaphragm as described in claim 1.

9. The sound generator as described in claim 8, wherein the convex part protrudes in a direction away from the magnetic circuit system.

* * * * *